US005803808A

United States Patent [19]

Strisower

[11] Patent Number: 5,803,808

[45] **Date of Patent: *Sep. 8, 1998**

[54] CARD GAME HAND COUNTER/DECISION COUNTER DEVICE

[75] Inventor: John M. Strisower, 376 Brookside Dr., Chico, Calif. 95928

[73] Assignee: John M. Strisower, Loma Rica, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 516,651

[22] Filed: Aug. 18, 1995

[51] Int. Cl.[6] ..... A63F 1/18

[52] U.S. Cl. ..... 463/11; 463/12; 463/40; 463/47; 273/309

[58] Field of Search ..... 463/11, 12, 13, 463/25, 29, 47; 273/292, 309, 150, 148 A

[56] References Cited

U.S. PATENT DOCUMENTS

| | | | |
|---|---|---|---|
| 3,124,674 | 3/1964 | Edwards et al. | 235/61 |
| 4,072,930 | 2/1978 | Lucero et al. | 463/47 |
| 4,283,709 | 8/1981 | Lucero et al. | 463/25 |

(List continued on next page.)

FOREIGN PATENT DOCUMENTS

| | | |
|---|---|---|
| 3807127 | 9/1989 | Germany . |
| WO9221413 | 12/1992 | WIPO . |
| WO 96/07153 | 3/1996 | WIPO . |

OTHER PUBLICATIONS

*Forbes Magazine,* 25 Oct. 1993, David H. Freedman, "Odds Man In" pp. 33–35, entire article.

*Lan Magazine,* vol. 7, No. 11, Nov. 1992, Pat Becker, "Gambling LAN"p. 171(5), entire article.

*Reno Gazette–Journal,* Wednesday, Jan. 18, 1995, "Radio Helps Casinos Spot Big Spenders" entire article.

Copy of first Declaration of Timothy J. Slater, dated Dec. 7, 1995, from prosecution history of U.S. patent application No. 08/417,211, filed Apr. 5, 1995, now U.S. Patent No. 5,613,912, 8 pages.

Copy of Declaration of Ann Metzger, dated Sep. 3, 1996, from prosecution history of U.S. Patent application No. 08/417,211, filed Apr. 5, 1995, now U.S. Patent No. 5,613, 912, two pages.

Copy of second Declaration of Timothy J. Slater, dated Sep. 3, 1996, from prosecution history of U.S. patent application No. 08/417,211, filed Apr. 5, 1995, now U.S. Patent No. 5,613,912, 4 pages.

*PitTrak Player Tracking System brochure,* "Introducing the Next Logical Step in Player Tracking," 8 pages (PRC Gamng Systems).

*Harrah's Automated Pit Player Tracking System, User's Guide,* 17 Jan. 1995, Harrah's internal document, pp. 2–17.

"PRC Player Tracking System Adds 44 Tables," *Central States Gaming,* p. 3, vol. 1, No. 12 (Apr. 17, 1995).

"In–Charge Card," *Electronics Now,* p. 4 (Aug. 1993).

PCT International Search Report mailed Jan. 20, 1997 for counterpart PCT application No. PCT/US96/12781.

"Scanjack, Where the Action's At" brochure, Peripheral Dynamics Inc., Plymouth Meeting, PA, two pages (faxed Aug. 14, 1995).

*Primary Examiner*—Jessica Harrison
*Assistant Examiner*—James Schaaf
*Attorney, Agent, or Firm*—Blakely, Sokoloff, Taylor & Zafman LLP

[57] ABSTRACT

A device is utilized in casino gaming environment that will count the number of hands of a given card game played per given period of time. The information is used by a database system within the casino to determine theoretical win/loss based upon historical and theoretical outcome data related to probability of winning/losing any given hand and then factoring in the number of hands played. Preferably this device is polled by a database system to collect this information. In a preferred embodiment, the device could be utilized with an automatic tracking and information management system.

34 Claims, 10 Drawing Sheets

U.S. PATENT DOCUMENTS

| | | | |
|---|---|---|---|
| 4,339,798 | 7/1982 | Hedges et al. | 463/26 |
| 4,373,726 | 2/1983 | Churchill et al. | 463/19 |
| 4,494,197 | 1/1985 | Troy et al. | 463/18 |
| 4,575,622 | 3/1986 | Pellegrini | 463/25 |
| 4,636,951 | 1/1987 | Harlick | 463/25 |
| 4,669,730 | 6/1987 | Small | 463/17 |
| 4,755,941 | 7/1988 | Bacchi | 463/26 |
| 4,882,473 | 11/1989 | Bergeron et al. | 463/25 |
| 4,926,327 | 5/1990 | Sidley | 463/13 |
| 5,038,022 | 8/1991 | Lucero | 463/25 |
| 5,083,271 | 1/1992 | Thacher et al. | 364/411.1 |
| 5,096,195 | 3/1992 | Gimmon | 463/20 |
| 5,103,081 | 4/1992 | Fisher et al. | 235/464 |
| 5,166,502 | 11/1992 | Rendleman et al. | 235/492 |
| 5,179,517 | 1/1993 | Sarbin et al. | 463/25 |
| 5,209,476 | 5/1993 | Eiba | 463/42 |
| 5,248,142 | 9/1993 | Breeding | 273/138.1 |
| 5,249,800 | 10/1993 | Hilgendorf et al. | 463/27 |
| 5,257,179 | 10/1993 | DeMar | 463/25 |
| 5,265,874 | 11/1993 | Dickinson et al. | 463/25 |
| 5,276,312 | 1/1994 | McCarthy | 463/26 |
| 5,283,422 | 2/1994 | Storch et al. | 235/375 |
| 5,287,269 | 2/1994 | Dorrough et al. | 705/17 |
| 5,321,241 | 6/1994 | Craine | 463/25 |
| 5,326,104 | 7/1994 | Pease et al. | 463/18 |
| 5,371,345 | 12/1994 | LeStrange et al. | 235/380 |
| 5,429,361 | 7/1995 | Raven et al. | 463/25 |
| 5,470,079 | 11/1995 | LeStrange et al. | 463/25 |
| 5,586,766 | 12/1996 | Forte et al. | 463/12 |
| 5,613,912 | 3/1997 | Slater | 463/25 |
| 5,655,961 | 8/1997 | Acres et al. | 463/42 |

CARD GAME HAND COUNTER/DECISION COUNTER DEVICE

FIELD OF THE INVENTION

The present invention is directed toward a tracking system for gaming transactions of a gaming establishment and more particularly to an apparatus that will track the number of hands of a given card game of a casino.

BACKGROUND OF THE INVENTION

In an analogy to frequent flyer programs that have been introduced by various airline carriers, oftentimes casinos provide frequent player incentives to casino players who play certain games at high betting levels. For example, a player bets at a certain dollar level (perhaps $100). To encourage continued betting at this level, a fraction of a theoretical win or a portion of the amount the person is playing will be applied to other activities within that particular organization.

A casino owner would like to track and manage transactions and player marketing data in a pit area of the casino. If a person plays a certain amount of money on a game like blackjack, there will be discounts provided for the hotel room or there may be a free hotel room.

Cards with magnetic strips or punched holes are used in the gaming tables of the pit area. The cards are typically utilized for tracking of players and their transactions within the casino.

Typically, a system for tracking transactions in a pit area of a casino is a manual paper-based one. In such a system, an employee in a pit area, typically the pit boss, writes down the betting levels called the bet rating of the players. The pit personnel must spend a considerable amount of time recording the transactions for later entry by the pit clerk. The bet rating is defined as the pit boss'best guess as to the player's betting level over time. This double entry results in errors and delays. Additionally, pit personnel spend an inordinate amount of time ensuring that proper credit is given to the respective players. Therefore, known manual systems are cumbersome and do not provide for true two way interactive performance.

In existing automated slot machine tracking systems, actual betting transactions in the gaming area are tracked. In the table gaming area of the casino (blackjack, craps and roulette) the betting rate of a player over a particular period of time is recorded manually as opposed to being transaction based. The actual transactions presently are not being recorded by the pit personnel.

Accordingly, what is needed is a system for tracking the number of hands played in a card game that is two way and provides for real time interactivity. The system should also be completely automatic.

The card game tracking system should be one which is readily adaptable to be utilized with existing casino databases to assure a seamless and integrated information system. The tracking and management system should also allow the personnel within the casino area to be free to perform other activities besides physically recording the transactions. It would be useful to provide a system in which the personnel would be able to interact more readily with the players. Accordingly, the present invention satisfies such a need.

SUMMARY OF THE INVENTION

The present invention comprises a device to be utilized in casino gaming that will count the number of hands of a given card game played per given period of time. The information is used by a database system within the casino to determine theoretical win/loss based upon historical and theoretical outcome data related to probability of winning/losing any given hand and then factoring in the number of hands played.

If a player is playing a game that has more decisions per hour (faster game) then that player is likely to lose more money in a given period of time. Also, if a given gaming table has more hands (and therefore more player decisions) per hour, it is likely to win more per hour than one with less hands and decisions per hour.

Perferably this device is polled by a database system to collect this information. In a preferred embodiment, the device could be utilized with an automatic tracking and information management system.

The automatic tracking and information management system (ATMS) automatically determines various player transactions associated with a device in a gaming establishment. The ATMS includes an automatic tracking and management unit (ATMU) which transmits and receives information between all gaming tables in all pit areas and the gaming establishment database system. The ATMU provides for the interactive determination of various transactions within the pit area. Through the automatic tracking and management system the manual paper tracking, activities associated with the pit area are eliminated, thereby freeing pit personnel for other tasks. The device could also be generically connected to any tracking and information system through any standard serial interface.

DETAILED DESCRIPTION OF THE DRAWINGS

The present invention relates to an improvement in the tracking of transactions in a casino. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The present invention is directed toward a device used in casino gaming area that will count the number of hands of a given card game played per given period of time. For example, 30 hands of Blackjack played within 1 hour. This information is used by the casino database to determine theoretical win/loss based upon historical and theoretical outcome data related to probability of winning/losing any given hand and then factoring in the number of hands played.

If a player is playing a game that has more decisions per hour (faster game) then that player is likely to lose more money in a given period of time. Also, if a given gaming table has more hands (and therefore more player decisions) per hour, it is likely to win more per hour than one with less hands and decisions per hour.

This device will typically be polled by some other device to collect this information. In a preferred embodiment, this device would be polled by an automatic device tracking and management system as disclosed in U.S. application Ser. No. 08/299,514, entitled "A System For The Tracking And Management Of Transactions In A Pit Area Of A Gaming Establishment."

Figure 1:
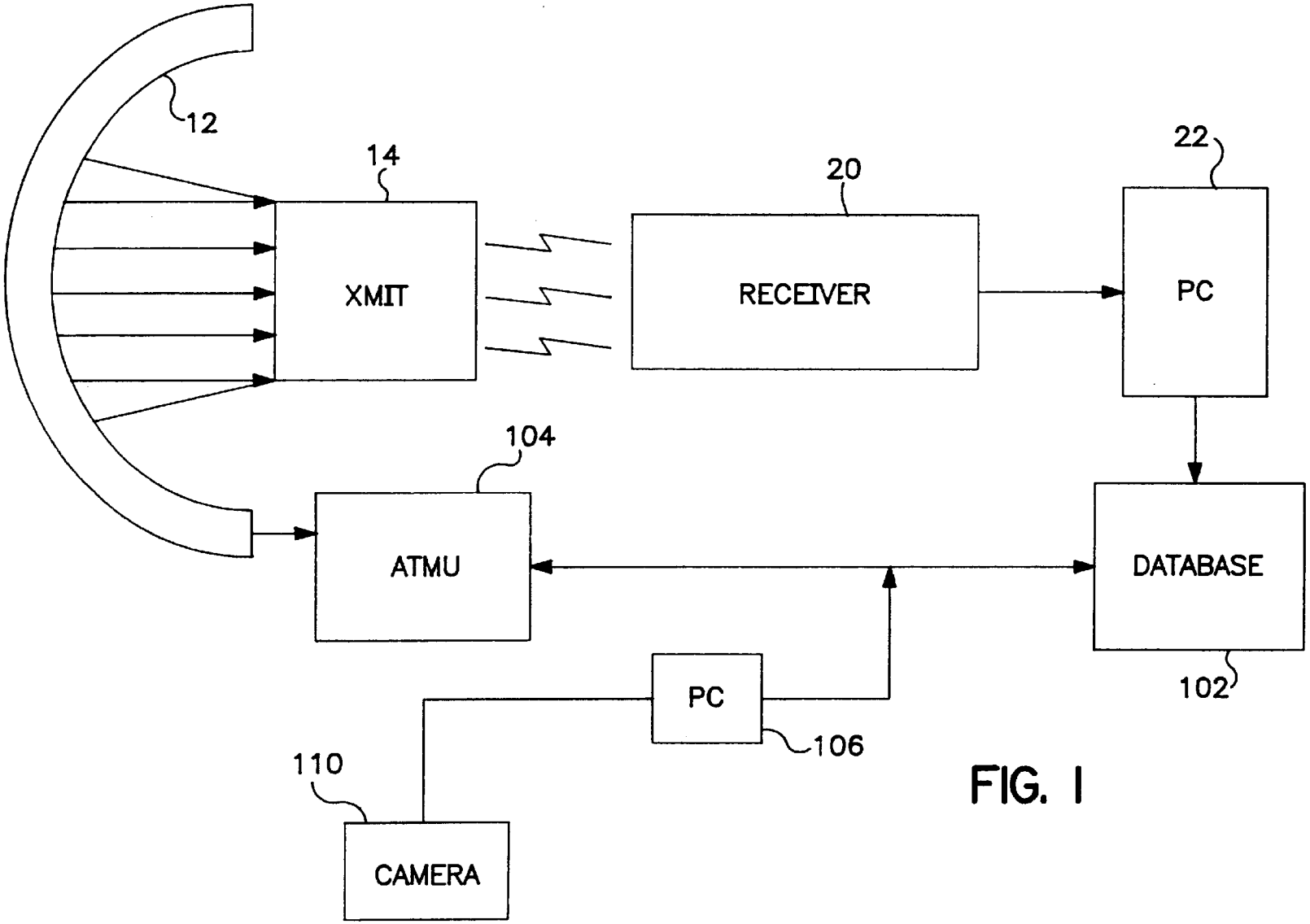
FIG. 1 is a block diagram of the automatic tracking and management system (ATMS) for a pit area of a casino.

FIG. 1 illustrates the automatic tracking and management system (ATMS) 100. As is seen, the casino database 102 is coupled to an automatic tracking and management unit (ATMU) 104. The ATMU 104 in turn is also coupled to a PC 106, which can provide casino surveillance and act as a terminal emulator. The ATMU 104 is also coupled to the network. This connection can be made via Ethernet, token ring, RF signal or the like. Through the ATMS 100, tracking and management of different transactions can be provided that is automatic, more accurate and more accessible than previously known systems. A key component to the operation of the ATMS 100 is the ATMU 104.

Figure 2:
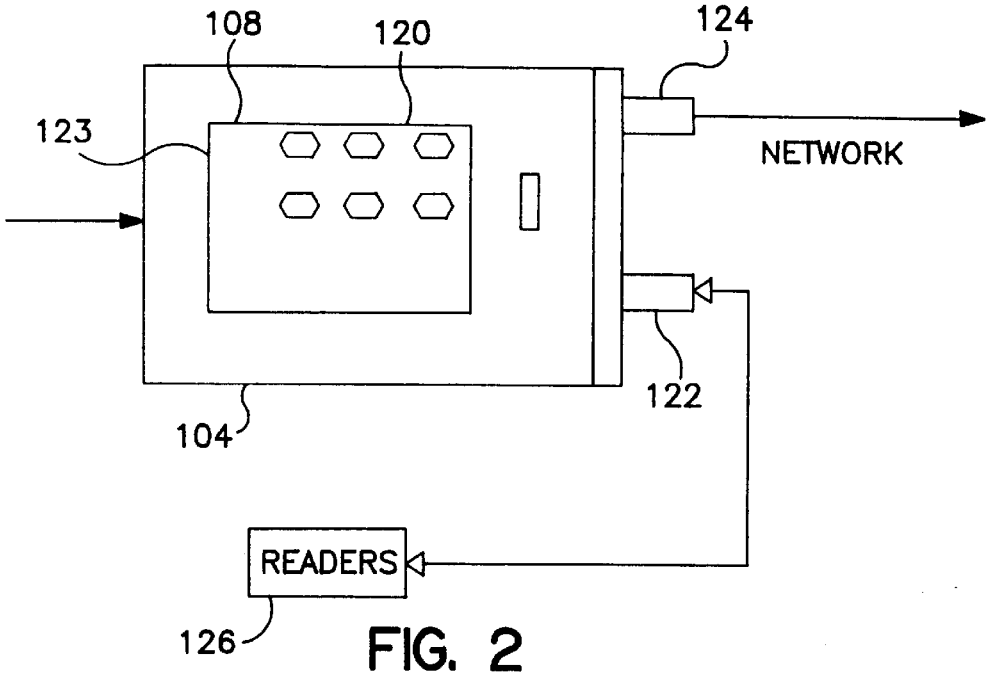
FIG. 2 is a diagram of an automatic tracking and management unit (ATMU) in accordance with the ATMS of FIG. 1

FIG. 2 describes the ATMU 104 module, which includes a screen 108 for viewing various transactions in the pit area. The screen 108, in a preferred embodiment is a touch-screen. However, one of ordinary skill in the art readily recognizes that a keyboard, mouse or other device could be used to input information and/or to modify the information on the screen 108 and their use would be within the spirit and scope of the present invention. The screen 108 of the ATMU 104 as shown comprises a plurality of icons 120 which in this embodiment indicates the betting level of each player at the table. In addition, the screen also contains information about the players, such as their names, addresses and the like, shown generally at 123.

The information on the screen can be changed and customized for a particular player's pattern. Through standard techniques, information can be changed and configured to describe a particular transaction.

The ATMU 104, in a preferred embodiment, also includes an ethernet port 124 which is coupled to the casino system database 102 and an RS485 port 122 which is coupled to card readers 126. Further, in a preferred embodiment the ATMU 104 also includes a magnetic strip reader which is utilized to read cards with magnetic strips and a slot for reading hole-punched cards. Finally, in a preferred embodiment, the ATMU 104 includes a CPU, memory, a hard drive, various computer programs for allowing the operation of the various elements and an application program to provide for automatic tracking and management of transactions in the pit area of the casino.

It should be understood, however, that although the present invention will be described in conjunction with this ATMS system of the copending patent application, it can be utilized with a variety of systems.

Figure 3:
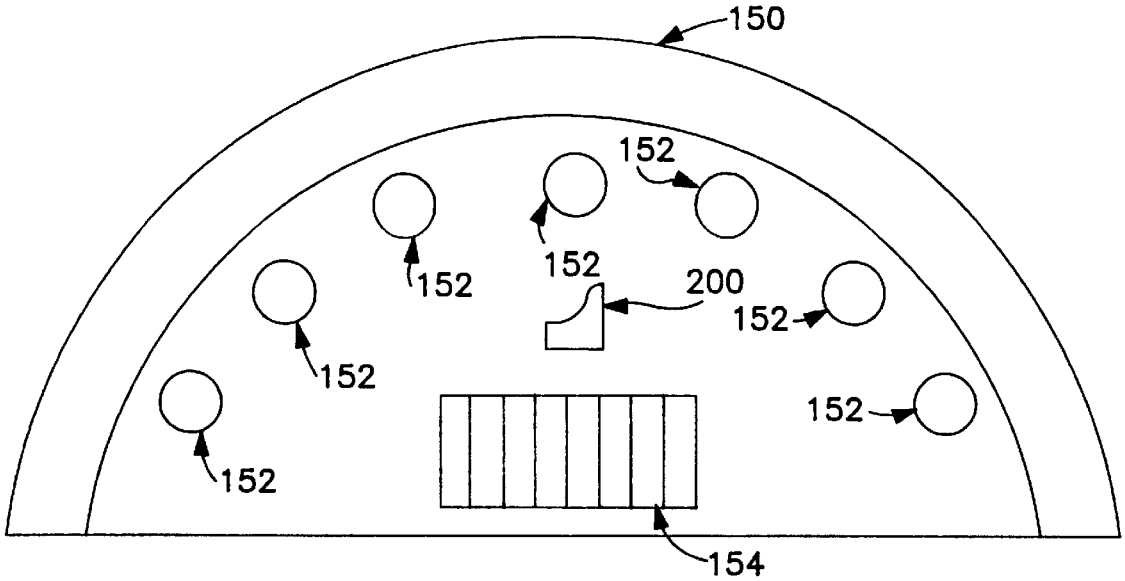
FIG. 3 is a top view of a typical blackjack gaming table including the card hand counter device in accordance with the present invention.

FIG. 3 shows a typical blackjack gaming table 150, which includes a card hand counter device 200 in accordance with the present invention. Gaming table 150 includes a plurality of player betting spots 152 and a tray 154 for holding the chips used for betting. The card hand counter device 200 is in communication with the ATMU 104.

Figure 4:
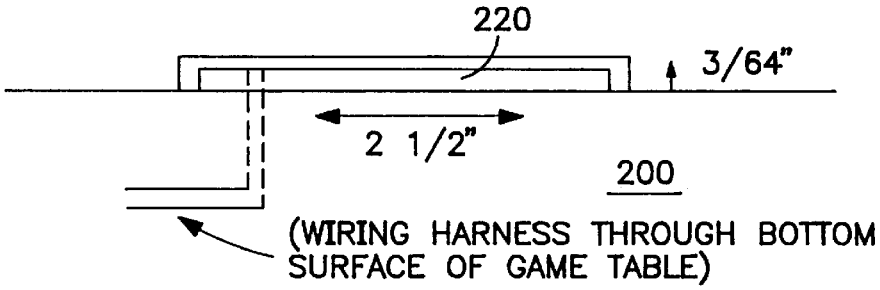
FIG. 4 is a side view of a card hand counter device of FIG. 1 showing opening side and wiring going through underside of gaming table surface.

Referring now to FIG. 4, what is shown is a side view of the counter device 200 in which is shown an opening in which cards can be inserted therewithin. The slightly tapered opening 220 helps funnel cards into the card hand counter device quickly and easily, and will also provide for rapid and accurate reading of the cards.

As contemplated by the present invention a card hand counter device could be in three different embodiments.

1. Card Hand Counter Device only—provides a number of hands per time interval.

2. Card Hand Counter Device with manually activated "No Peeky" device—allows for counting of hands per time interval and has 2 manually activated switches operated by the dealer to indicate that a "10" value card is face up and then the unit displays a light indicating whether the hidden (hole) card is an ace of value "11". If so, it is called a Blackjack or "21". In the case of a "21" an internal Blackjack or 21 accumulator is incremented by one. If the ace is not present the unit shows a negative indication and play is resumed as normal. If an ace is up the dealer presses an ace button which instructs the counter to check for any card with a value of "10", if it exists, the 21 accumulator is incremented and the blackjack indicator illuminates. If not, the negative indication illuminates and play resumes.

3. Card Hand Counter Device with automatic Blackjack indication. This device is exactly the same as the unit described above and it has two card recognition scanners, one on top and one on bottom so it can automatically check for the blackjack when instructed to do so by the operation of a switch. This device will cost more but offers less training time and less dealer operation time and eliminates possible mistakes made in using a two switch system. These devices will now be described in more detail.

Figure 5:
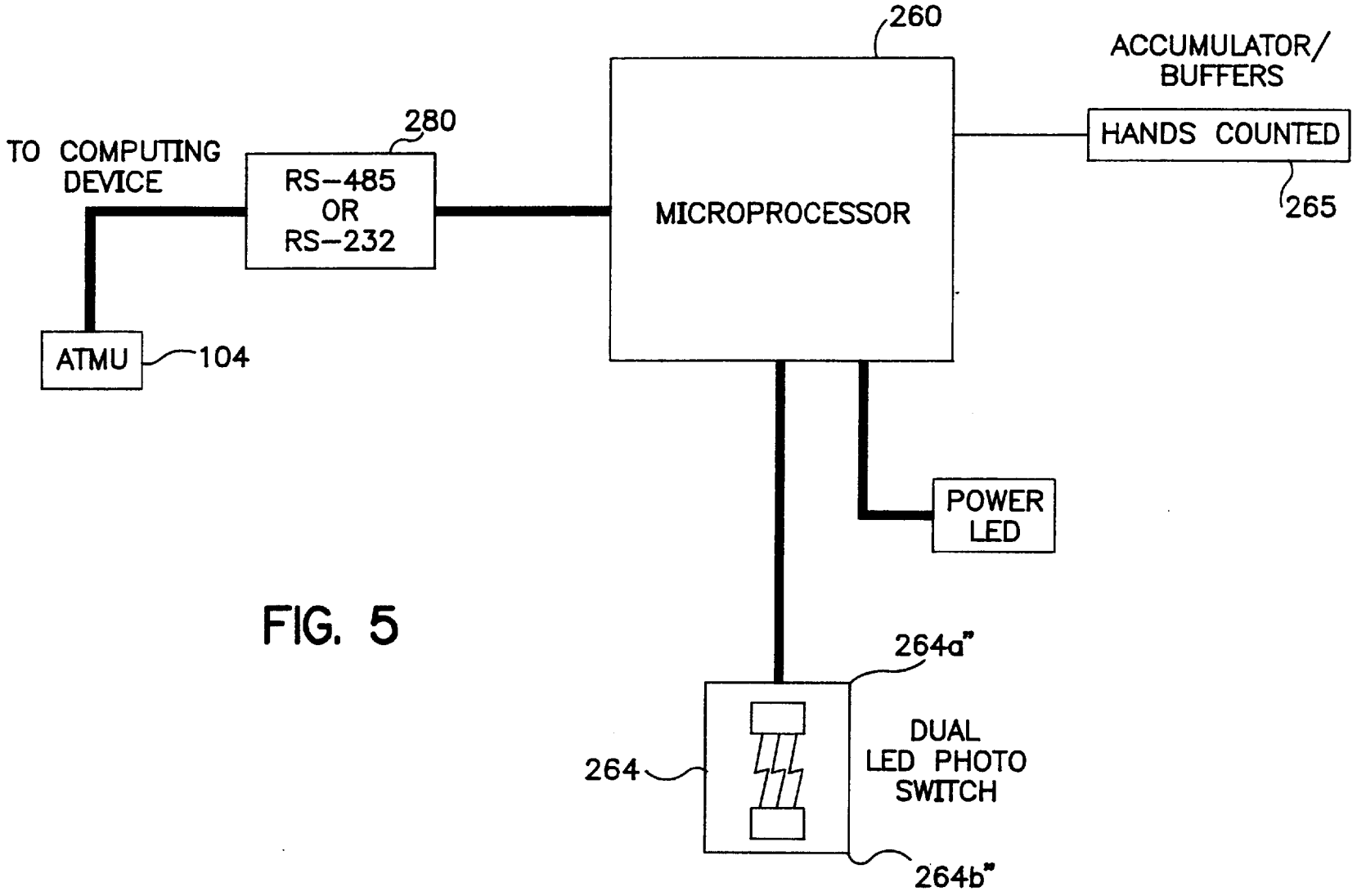
FIG. 5 is a block diagram of a first embodiment of a card hand counter device in accordance with the present invention.

FIG. 5 is a block diagram of a first embodiment of a card hand counter device 200 in accordance with the present invention. In this embodiment, a microprocessor 260 is coupled to the ATMU 104 with a standard or proprietary communications interface cable and protocol. The preferred embodiment is via RS-485 communications interface 280 with the device 200 being able to be addressed with as many as 31 other devices per communications line. An RS-232c serial interface is optional and can be used for computing devices not capable of supporting RS-485 communications.

The basic operating principle of the card hand counter device 200 in the first embodiment is that the card or cards slid into the card hand counter device 200 break a beam of light between two LEDs 264 located therewithin. One LED 264A (top) transmits light down to the second LED 264B (bottom) which induces a current and represents no cards/no hand present. When the beam of light is broken by the card(s) of a hand for a period of one second (preferred embodiment timing) or more, the unit increments an accumulator 265 (hand counter buffer) by 1.

When the device is polled for information from the microprocessor 260 it sends the value contained in the hand counter accumulator buffer 265 to the ATMU 104. Once the protocol defining message received from microprocessor 260 is registered by the device, it clears the hand counter buffer 265 and is then ready to count more hands.

Figure 6:
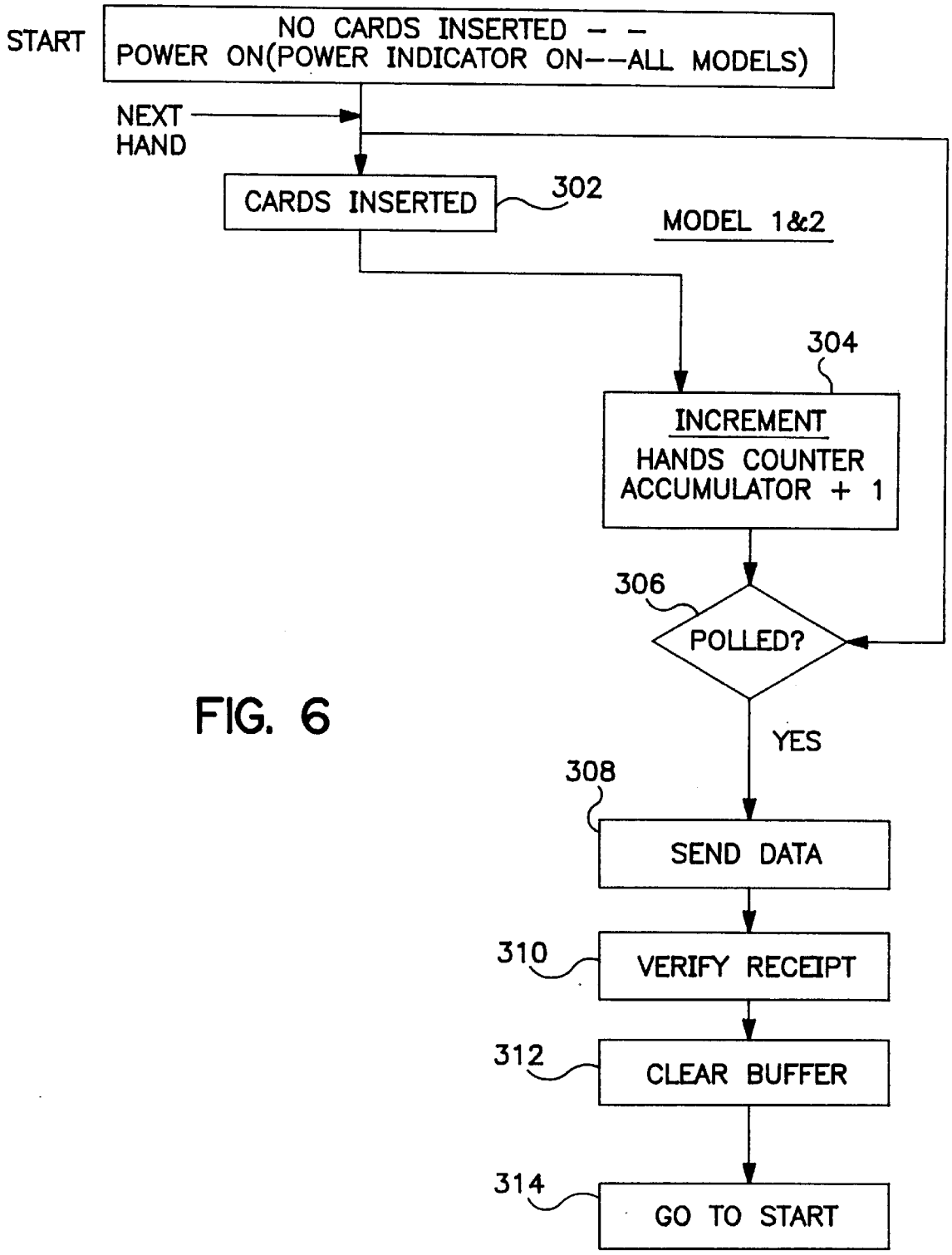
FIG. 6 is a flow chart showing the operation of the card hand counter device of FIG. 5 in accordance with the present invention.

FIG. 6 is a flow chart showing the operation of the card hand counter device of FIG. 5 in accordance with the present invention. As is seen, first a card is inserted via steps 302, then the counter is incremented via step 304. A determination is made as to whether the counter is to be polled via step 306. If the device is not to be polled then to return to step 302. If the device is to be polled then the data is sent to the polling device via step 308. The receipt of data is verified via step 310 and the buffer is then cleared via step 312. Thereafter the system is returned to the start via step 314.

Figure 7:
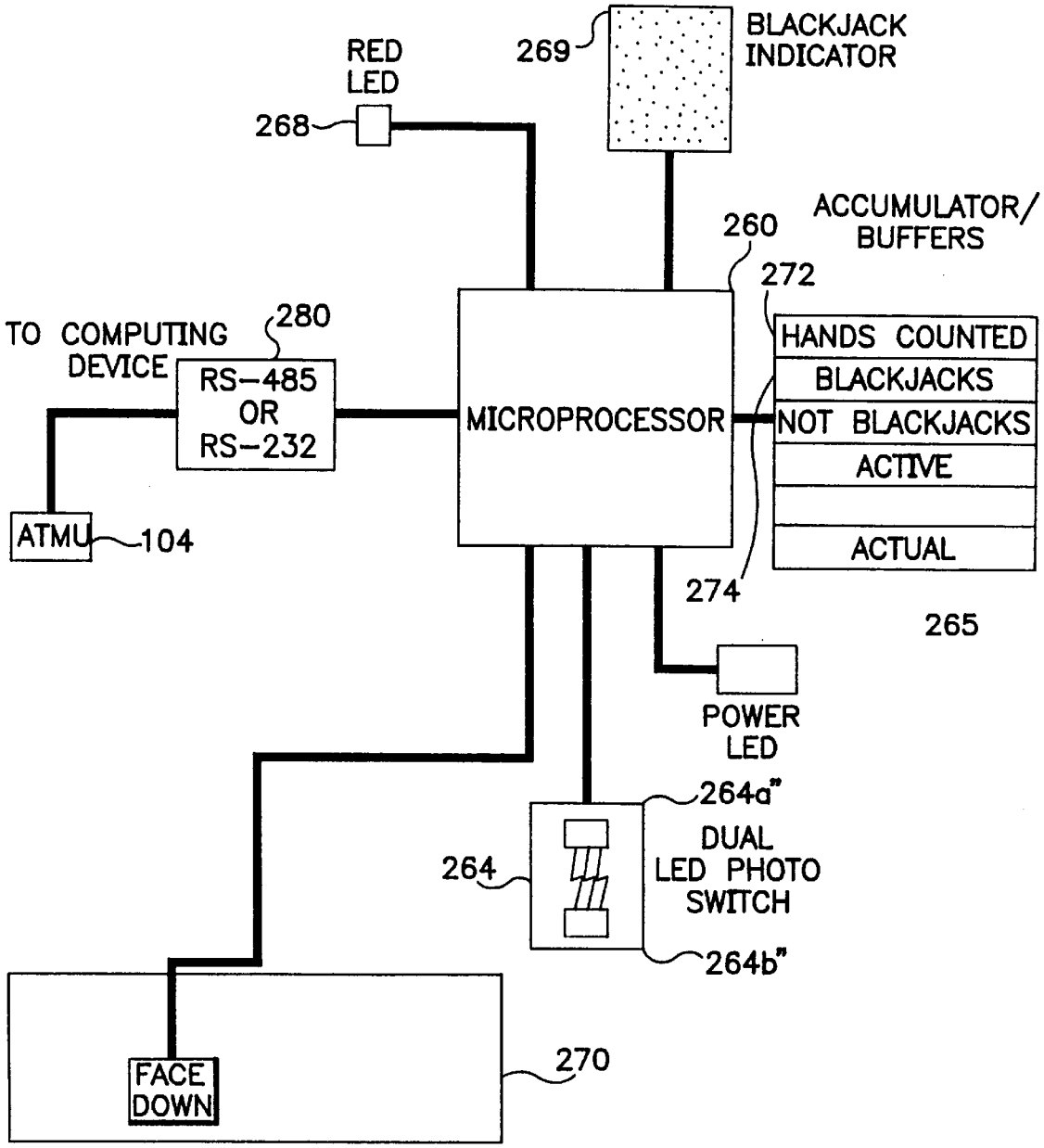
FIG. 7 is a block diagram of a second embodiment of a card hand counter device in accordance with the present invention.

FIG. 7 is a block diagram of a second embodiment of a card hand counter device 200' in accordance with the present invention. Card hand counter device 200' also integrates a manually activated Blackjack detector or "no Peeky" device 270.

Figure 8:
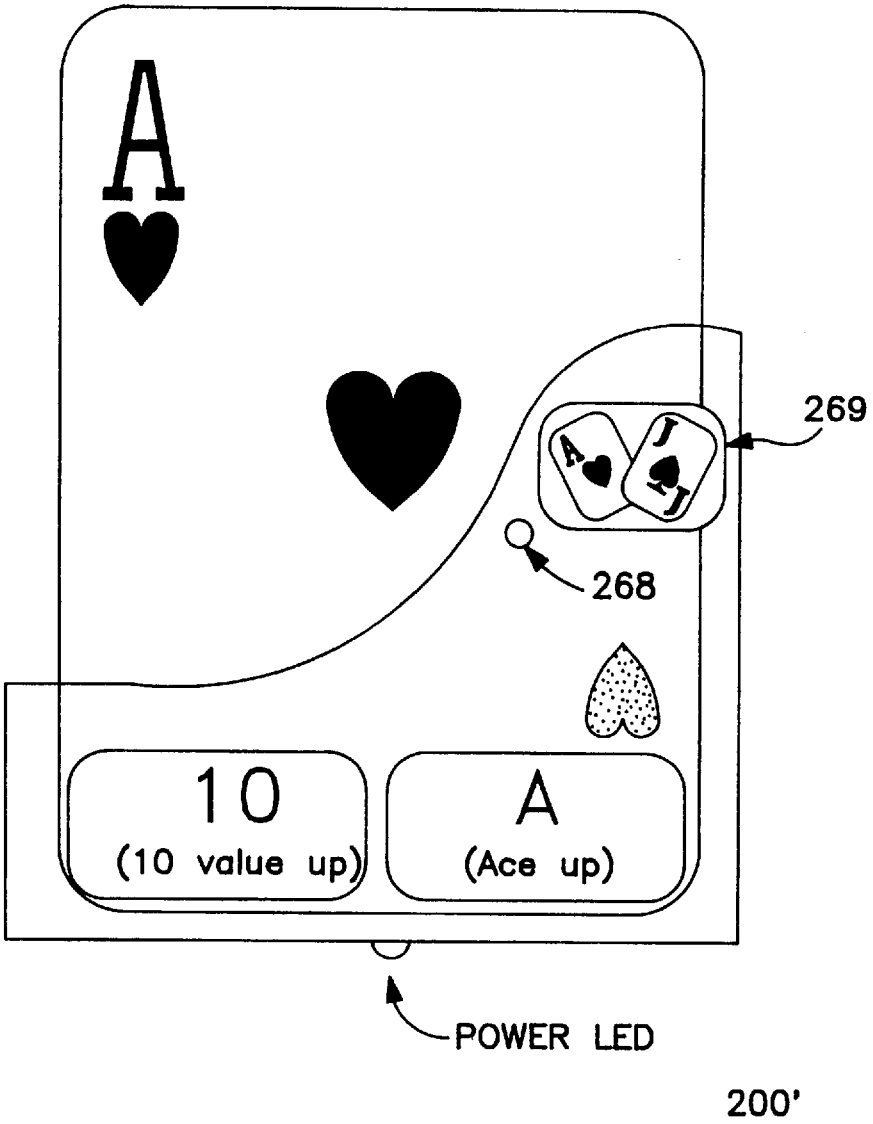
FIG. 8 is an illustration of the card hand counter device in accordance with FIG. 7.

Referring now to FIG. 8, when a 21 dealer's first two cards (bottom one face-down, top one face-up) are inserted into the device 200', the dealer can manually instruct the device 200' to "look" for a ten-value card (10, Jack, Queen, King of any suit) by pressing the "Ace" button 350 (this would be the case because the dealer will only "look" for a ten-value card after receiving an ace face-up and asking players for 21 insurance). If the face-down bottom card is in fact a ten-value card, a 21 or Blackjack indicator LED will glow illuminating the blackjack symbol, if not, a small green LED indicator 268 will light to confirm it has "looked" and not found a ten-value card. If the dealer has a ten-value card face-up on top and therefore needs to check for an ace face-down on the bottom, the same procedure is used (except that insurance is not offered to the players) and the "Ten" button 352 is pressed. If an ace is face-down on the bottom, the Blackjack 269 indicator lights up, if not the green LED 268 lights showing no ace and therefore no blackjack or 21.

The device 200' shown in FIG. 7 also has a blackjack's checked accumulator 265' that stores two values. One value is the number of hands checked since the last polling and clearing buffer 272. The second value is number of blackjacks 274 (positive results). These two numbers can be of value for statistical purposes for the casino. Once these values are requested by polling from the computing device and the polled data is acknowledged by the computing device, these buffers are cleared to be used for collection of new data.

Figure 9:
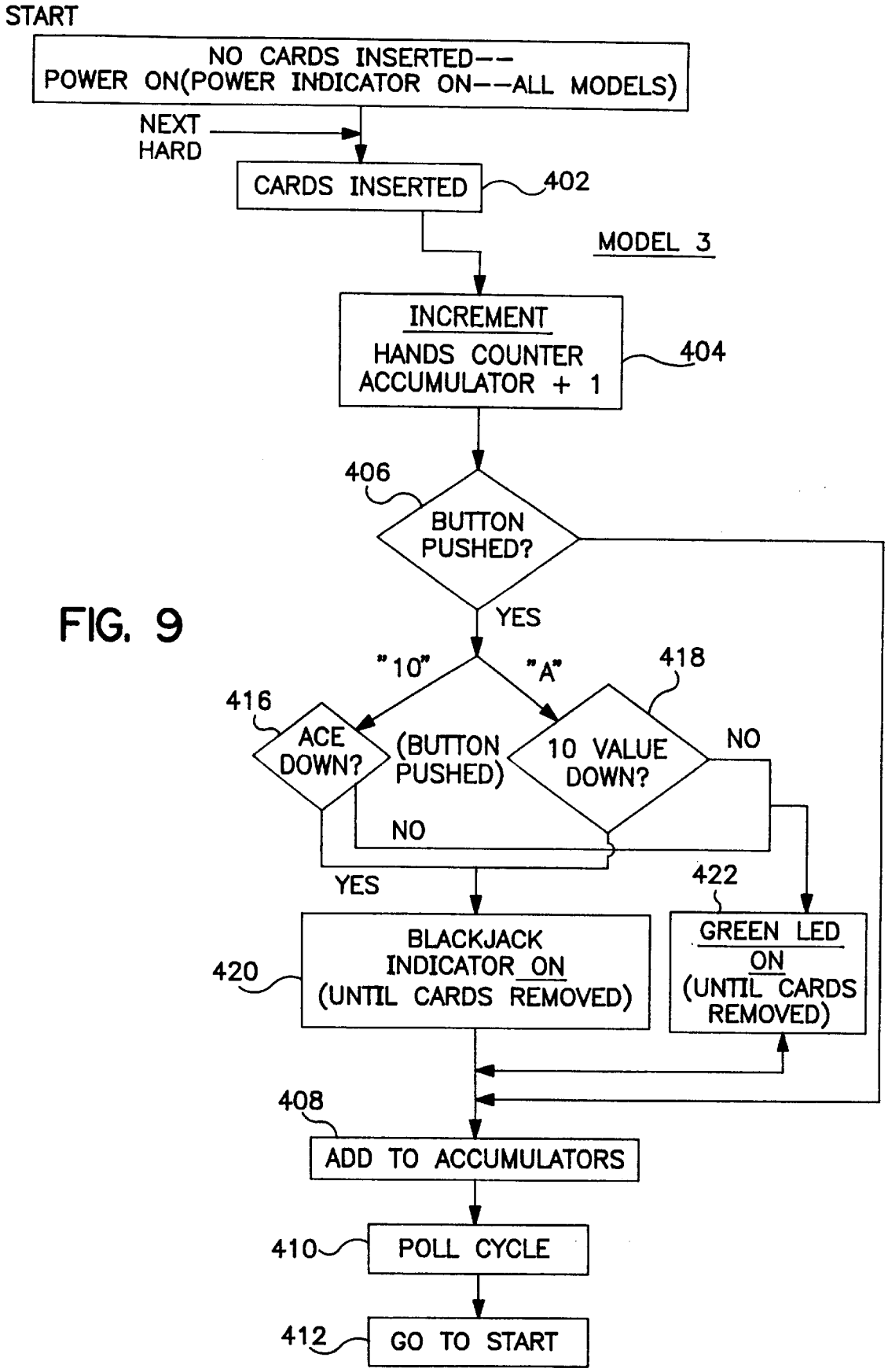
FIG. 9 is a flow chart showing the operation of the card hand counter device of FIG. 7 in accordance with the present invention.

FIG. 9 is a flow chart showing the operation of the card hand counter device of FIGS. 7 and 8 in accordance with the present invention. As is seen first the cards are inserted, via step 402, the counter is then incremented via step 404. Next a determination must be made as to whether either the ace or ten button is to be pushed via step 406. If neither a ten or an ace is showing then the hand is added to accumulator via step 408. Thereafter the device is polled via step 410 and the device is returned to the start via step 412. If, however, an ace or ten is up via steps 414 and 416 respectively the appropriate button is then pushed. A card reader is utilized to determine if an ace or ten is down. If the appropriate card is down the blackjack indicator 269 will light. Thereafter steps 308 to 312 are repeated to return to the start.

Figure 10:
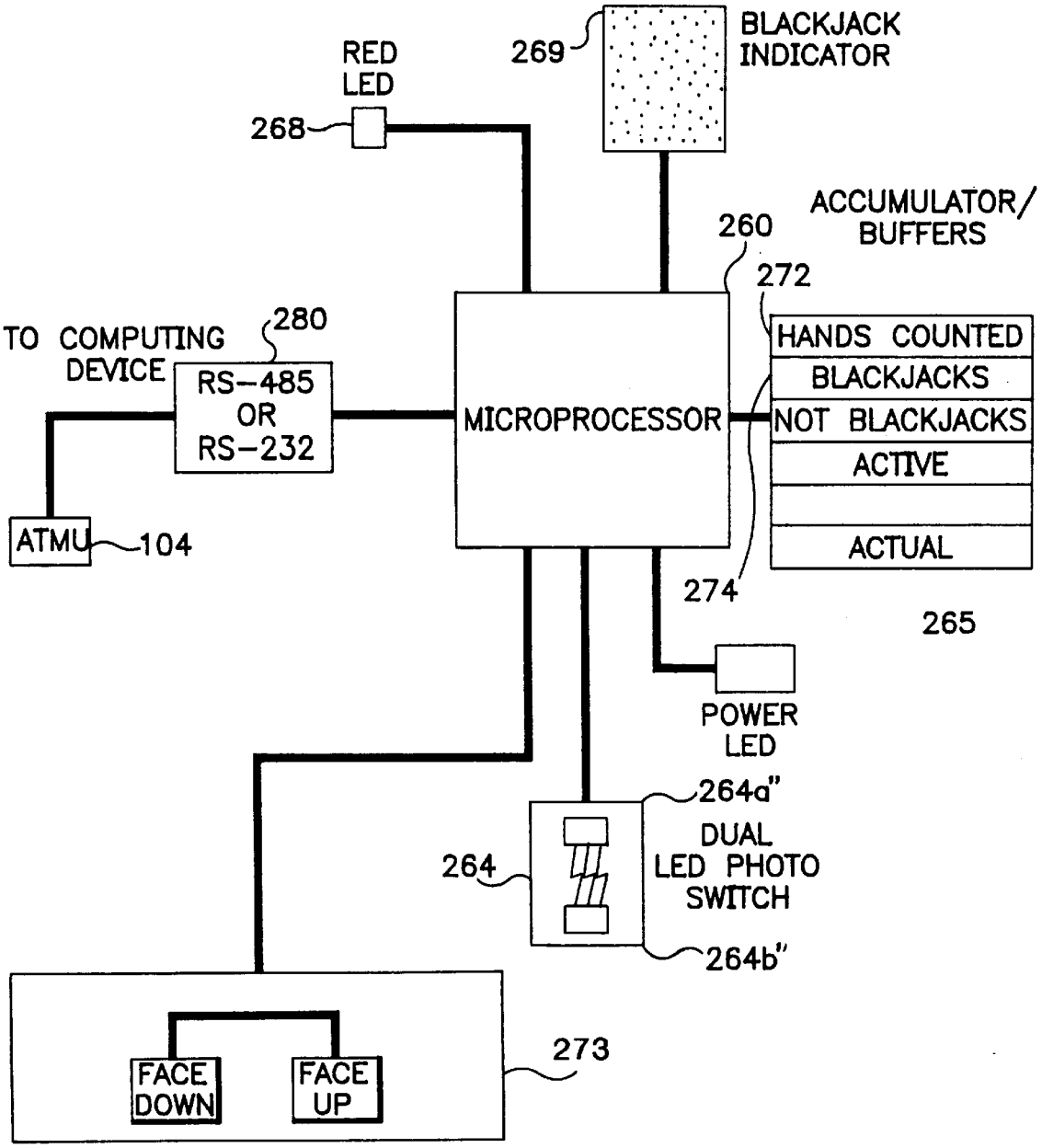
FIG. 10 is a block diagram of a third embodiment of a card hand counter device in accordance with the present invention.
Figure 11:
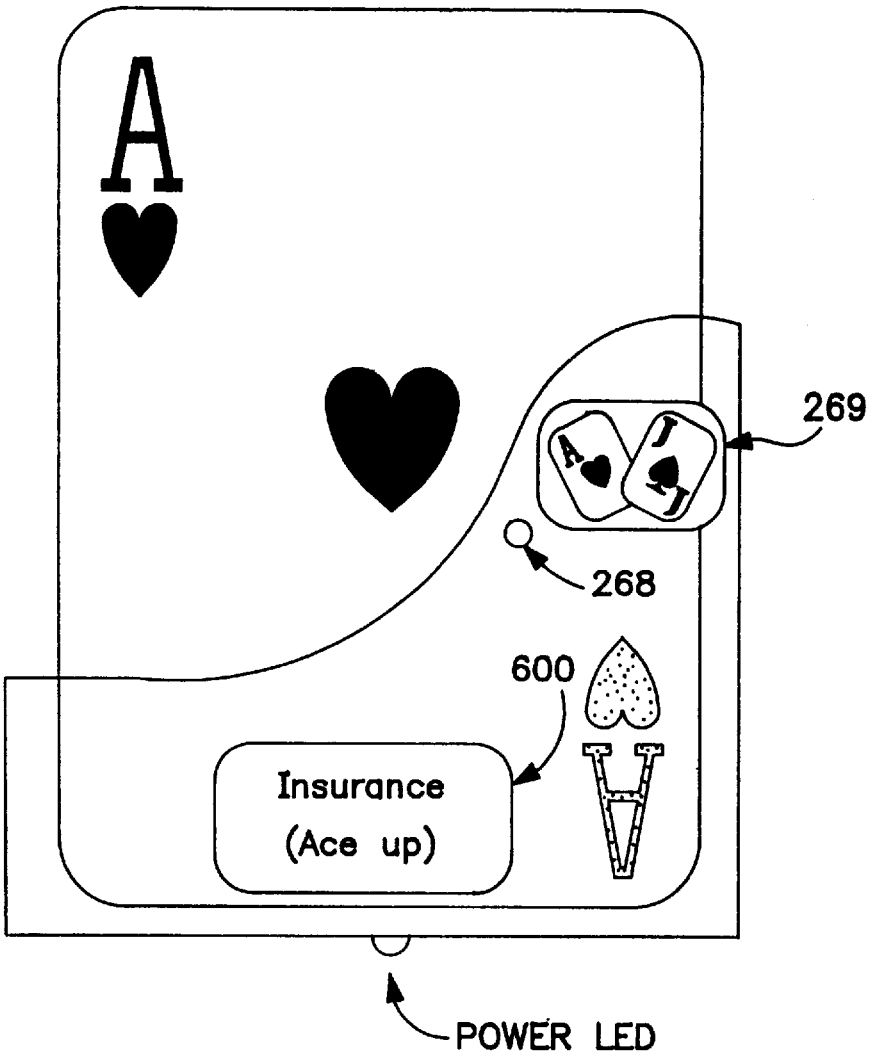
FIG. 11 is an illustration of the card hand counter device in accordance with FIG. 10.

The card hand counter device 200" shown in FIGS. 10 and 11 has all of the same features as that shown in FIG. 7 except that the device 20'0' has only one switch with a light that says "Insurance" and also includes a face up and face down card reader 273. If a hand comprising one face-down card and one face-up card is slid into the unit it performs the hand counter functions but also "looks" for an ace face-up. If it sees a face-up ace it illuminates the "Insurance" indicator in the switch. This is a signal to remind the dealer that insurance needs to be offered to the players. Once insurance is tendered, the dealer simply presses the insurance button to instruct the unit to look for a 21. With the exception of an ace face-up, any two cards will immediately and automatically be "looked" at by the device. If it sees any 21 combination (one ace top or bottom and one ten-value card opposite the ace), the blackjack indicator will illuminate, otherwise the green LED indicating a successful read and no blackjack will illuminate. The device shown in FIGS. 8 and 9 has additional features in that it will read the value of each first-two dealer cards that can be polled and cleared as other data is in the previous models. For example, if the unit has not been polled for 4 hands it might contain the following data: hand 1: 10-6, hand 2: 8-9, hand 3: 10-A, hand 4:4-7. This data can then be polled and cleared by the computing device.

Figure 12:
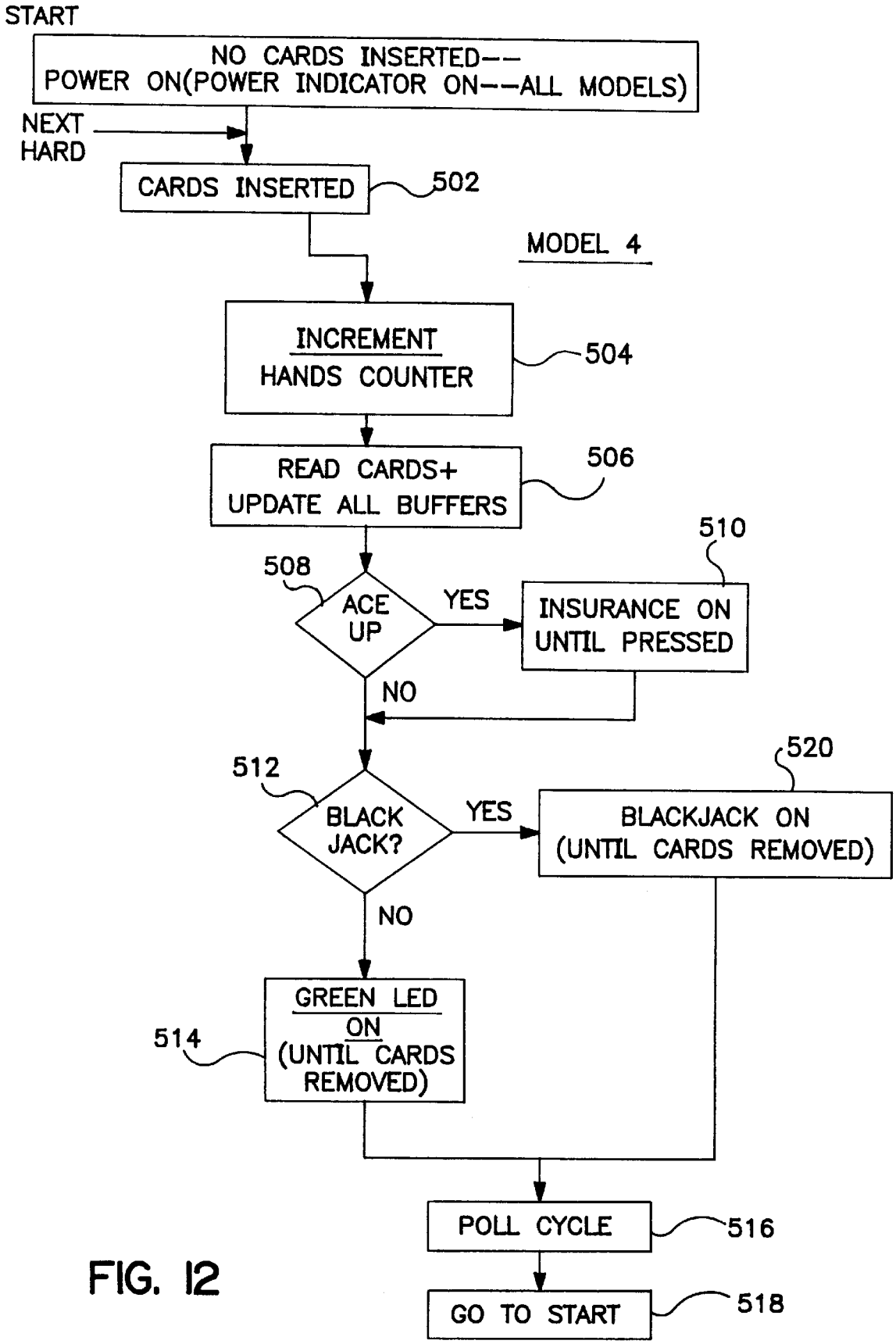
FIG. 12 is a flow chart showing the operation of the card hand counter device of FIG. 10 in accordance with the present invention.

FIG. 12 is a flow chart showing the operation of the card hand counter device of FIGS. 10 and 11 in accordance with the present invention. As is seen first the cards are inserted, via step 502, the counter is then incremented via step 504. Next, cards are read and the buffer is updated via step 506. Next a determination is made whether the ACE is up, via step 508. If the ace is up, then the insurance button 600 is pressed via step 510. If the ace is not up then a blackjack determination is made via step 512. If there is no blackjack the green LED indicator 268 is activated via step 414. The cycle is polled via step 516 and then returned to start via step 518. If there is a blackjack, the blackjack indicator 269 is active, via step 520 and steps 516 and 518 are indicated.

Although the present invention has been described in accordance with the embodiments shown, one of ordinary skill in the art will readily recognize that there could be variations to the embodiments and those variations would be within the spirit and scope of the present invention. For example, although this device has been described in conjunction with a blackjack game, one of ordinary skill in the art will readily recognize that this device would have application to a variety of card games. In addition, it is understood that even though particular cards are recognized, i.e., aces or cards with a value of ten, many other cards could be recognized and their use would be within the spirit and scope of the present invention. Accordingly, many modifications may be made by one of ordinary skill in the art without departing from the spirit and scope of the appended claims.

I claim:

1. A card hand counter device comprising:

reader means for receiving and recognizing that a card hand is within the device; and memory means coupled to reader means for accumulating the number of hands inserted into the reader means.

2. The card hand counter device of claim 1 which includes an interface means for allowing for polling of the device.

3. The card hand counter device of claim 1 in which the reader means comprises:

a detector means for detecting that the card hand is within the device.

4. The card hand counter device of claim 3 in which the detector means comprises:

a photodetector arrangement; and a processor means coupled to the photodetector arrangement for causing the memory means to accumulate the number of hands responsive to the photodetector means.

5. The card hand counter device of claim 4 in which the photodetector arrangement comprises first and second LEDs.

6. The card hand counter device of claim 5 in which the interface means is connectable to an automatic device for collecting and processing data, wherein the automatic device polls the card hand counter device.

7. The card hand counter device of claim 6 further comprising:

means for detecting a first particular card in a hand;

means for signaling detection of the first particular card;

means for determining whether a second particular card is present in the hand when detection of the first particular card is signaled; and means for signaling detection of the second particular card.

8. A method for counting a number of hands played in a card game comprising the steps of:

a) receiving and recognizing that a card hand is within a reader means of a device; and b) accumulating the number of hands inserted into the reader means.

9. The method of claim 8 which includes the steps of:

c) receiving an inquiry regarding the number of hands accumulated;

d) responding to the inquiry by transmitting the number of hands accumulated; and e) setting the number of hands accumulated to zero.

10. The method of claim 8 in which the receiving and recognizing step (a) comprises the step of detecting that the card hand is within the device.

11. The method of claim 8 which includes the steps of:

detecting a first particular card in a hand;

signaling detection of the first particular card;

determining whether a second particular card is present in the hand when detection of the first particular card is signaled; and signaling detection of the second particular card.

12. A method for counting a number of hands in a card game comprising the steps of:

a) inserting a card hand within a device;

b) incrementing a counter of the device responsive to a card hand being inserted;

c) determining if the device is to be polled; if the device is not to be polled returning to step (a); if the device is to be polled;

d) sending data to a polling device; and e) returning to step (a).

13. The method of claim 12 in which step (d) further comprises:

d1) verifying receipt of data at the polling device; and d2) setting the counter to zero.

14. The method of claim 12 which includes the steps of:

detecting a first particular card in a hand;

signaling detection of the first particular card;

determining whether a second particular card is present in the hand when detection of the first particular card is signaled; and signaling detection of the second particular card.

15. The card hand counter device of claim 6 further comprising:

means for detecting the presence of a first particular type of card with a second particular type of card in a hand; and means for signaling detection of the first and second particular types of card in the hand.

16. The method of claim 8 further comprising the steps of:

detecting the presence of a first particular type of card with a second particular type of card in a hand; and signaling detection of the first and second particular types of cards in the hand.

17. The method of claim 12 further comprising the steps of:

detecting the presence of a first particular type of card with a second particular type of card in a hand; and signaling detection of the first and second particular types of cards in the hand.

18. A card hand counter device comprising:

a card reader configured to receive a card hand and recognize that the card hand is within the card reader; and a memory device coupled to the card reader configured to accumulate a number of hands inserted into the card reader.

19. The card hand counter device of claim 18 further comprising a communications interface configured to allow polling of the device.

20. The card hand counter device of claim 18, wherein the card hand reader comprises detection circuitry configured to detect that the card hand is within the device.

21. The card hand counter device of claim 20, wherein the detection circuitry comprises:

a photodetector device; and a processor means coupled to the photodetector arrangement configured to cause the memory device to accumulate the number of hands responsive to the photodetector device.

22. The card hand counter device of claim 21, wherein the detection circuitry further comprises first and second light emitting diodes (LEDs).

23. The card hand counter device of claim 22 further including a blackjack indicator means coupled to the reader means.

24. The card hand counter device of claim 18, wherein the detection circuitry is coupled to an automatic tracking and management unit (ATMU).

25. An apparatus for counting card game hands, comprising a first image recognition device configured to receive a hand of cards and to scan a first card in the hand facing in a first direction and to transmit a first signal when the first card is a card of a first type.

26. The apparatus of claim 25, further comprising a second image recognition device configured to scan a second card in the hand facing in a second direction and to transmit a second signal when the first card is of the first type and the second card is of a second type.

27. The apparatus of claim 25, further comprising a counter device that accumulates a number of hands per unit time for a player and transmits the number of hands per unit time to a memory device.

28. The apparatus of claim 27, wherein the counter device further comprises a light emitting diode (LED).

29. The apparatus of claim 28, further comprising a communications interface, wherein the counter device receives a polling inquiry via the communications interface and transmits a card game hand count via the communications interface.

30. The apparatus of claim 25, further comprising an activation device configured to allow manual initiation of operation of the first image recognition device.

31. The apparatus of claim 26, further comprising an activation device configured to allow manual initiation of operation of the first image recognition device.

32. The apparatus of claim 25, wherein transmission of the first signal includes activation of a visible indicator device.

33. The apparatus of claim 26, wherein transmission of the second signal includes activation of a visible indicator device.

34. The apparatus of claim 26, further comprising a first accumulator configured to store a number of hands in which the first card is of the first type and the second card is of the second type.

* * * * *